US005824168A

United States Patent [19]

Miyamoto et al.

[11] Patent Number: 5,824,168

[45] Date of Patent: Oct. 20, 1998

[54] PROCESS FOR GEAR-ROLLING A HIGH ACCURACY GEAR

[75] Inventors: Noritaka Miyamoto; Masazumi Onishi, both of Toyota; Yasuyuki Fujiwara, Aichi-ken; Toshiaki Tanaka, Nagoya; Masatoshi Sawamura, Nagoya; Atsushi Danno, Nagoya, all of Japan

[73] Assignee: Toyota Jidosha Kabushiki Kaisha, Toyota, Japan

[21] Appl. No.: 706,251

[22] Filed: Sep. 4, 1996

[30] Foreign Application Priority Data

Sep. 6, 1995 [JP] Japan ..... 7-229273

[51] Int. Cl.[6] ..... C21D 1/10; C21D 9/32

[52] U.S. Cl. ..... 148/573; 29/893.32; 72/108

[58] Field of Search ..... 29/893.32; 148/573, 148/586; 72/108

[56] References Cited

U.S. PATENT DOCUMENTS

| | | | |
|---|---|---|---|
| 3,273,366 | 9/1966 | Schuman | 29/896.32 |
| 3,914,083 | 10/1975 | Arai . | |
| 4,708,912 | 11/1987 | Huppmann | 29/896.32 |
| 5,562,785 | 10/1996 | Yamanaka | 29/896.32 |

FOREIGN PATENT DOCUMENTS

| | | |
|---|---|---|
| A-53-17550 | 2/1978 | Japan . |
| A-54-62148 | 5/1979 | Japan . |
| A-54-99055 | 8/1979 | Japan . |
| A-61-222648 | 10/1986 | Japan . |

OTHER PUBLICATIONS

Database WPI, Week 9433, Oct. 5, 1994, Derwent Publications Ltd. AN 9427111333, SU–A–1 200 461, Jan. 30, 1994.

Database WPI, Week 9149, Jan. 29, 1992, Derwent Publications Ltd., AN 9136007549, SU–A–1 639 856, Apr. 7, 1991.

Database, WPI, Week 9426, Aug. 17, 1994, Derwent Publications Ltd., AN 9421591326, SU–A–1 810 196, Apr. 23, 1993.

*Primary Examiner*—P. W. Echols

*Attorney, Agent, or Firm*—Oliff & Berridge, PLC

[57] ABSTRACT

According to the present invention, in a heating step, an outer circumferential portion of a workpiece having a disk shape is heated to high temperatures. In a hot rough-rolling step, the outer circumferential portion of the heated workpiece is formed by use of a roller die to generate a rolled-gear having teeth. In a warm finish-rolling step, the teeth of the rolled-gear are finish-rolled by use of the finishing roller die. The starting temperature $T_1$ of the hot rough-rolling step is set in the range of from 850° through 1100° C., the terminating temperature of the hot rough-rolling step $T_2$ is set in the range of from 500° through 700° C. The starting temperature $T_3$ of the warm finish-rolling step is set in the range of from 400° through 700° C., and the terminating temperature of the warm finish-rolling step $T_4$ is set in the range of from 200° through 650° C.

12 Claims, 13 Drawing Sheets

PROCESS FOR GEAR-ROLLING A HIGH ACCURACY GEAR

BACKGROUND OF THE INVENTION

1. Field of Invention

The present invention relates to a process for gear-rolling a high accuracy gear and is applicable to the production of vehicle-flywheels having teeth and gears used in driving systems.

2. Description of Related Art

Generally, gears have been produced by way of a hob-cutting step and a shaving finish-step with respect to a disk-shaped workpiece. In this technique, when an outer diameter and a facewidth of the gear are increased, production efficiency is reduced and production costs are increased.

Accordingly, there has been developed a gear-rolling process for generating gear-teeth by use of a rolling step. In accordance with this process a blank, a disk-shaped workpiece made of metal, is heated to high temperatures, and a pair of rotating roller dies is squeezed into the outer circumferential portion of the blank. In this manner, the teeth can be generated in the outer circumferential portion of the workpiece.

Moreover, conventionally, there has been developed a technique for cold-rolling the gear produced by means of a hob-cutting step to finish the gear.

Although this gear-rolling process is advantageous in decreasing costs in comparison with the process using the aforementioned hob-cutting step and the shaving finish-step, this gear-rolling process is not sufficient in improving the accuracy of the teeth.

Also, according to the technique for cold-rolling the gear produced by means of a hob-cutting step to finish the gear, rectifying tooth-runout, cumulative pitch errors and other errors on the gear is substantially impossible.

SUMMARY OF THE INVENTION

The present invention has been developed in view of the aforementioned circumstances. It is therefore an object of the present invention to provide a process for gear-rolling a high accuracy gear which can acquire high accuracy teeth incapable of being produced utilizing conventional gear-rolling.

In a first aspect of the present invention, a process for gear-rolling a high accuracy gear uses a roller die for generating teeth and a finishing roller die for finishing the teeth. The process comprises the steps of first heating an outer circumferential portion of a workpiece having a disk shape to high temperature; followed by hot-rolling the outer circumferential portion of the heated workpiece by use of the roller die and generating teeth at the outer circumferential portion of the workpiece so that a rolled-gear is formed; then warm-rolling the teeth of the rolled-gear utilizing a finishing roller die.

In a second aspect of the present invention, the workpiece is made of iron-based material, starting temperature $T_1$ of the hot rough-rolling step is set in the range of from 850° through 1100° C., terminating temperature of the hot rough-rolling step $T_2$ is set in the range of from 500° through 700° C., starting temperature $T_3$ of the warm finish-rolling step is set in the range of from 400° through 700° C., and terminating temperature of the warm finish-rolling step $T_4$ is set in the range of from 200° through 650° C.

In a third aspect of the present invention, the process for gear-rolling a high accuracy gear uses a roller squeezing apparatus in which the roller die and the finishing roller die are disposed coaxially and connected in series in the axial direction of the roller die, and the warm finish-rolling step is continuously carried out immediately after the hot rough-rolling step without decreasing the temperature of the rolled-gear to a normal temperature range.

In the first aspect of the present invention, the warm finish-rolling step can be carried out immediately after the hot rough-rolling step. Therefore, the rectified effect is ensured with respect to the rolled-gear to ensure the accuracy of rolled-gear. Accordingly, it is advantageous that the as-rolled gear has high accuracy.

In the second aspect of the present invention, the predetermined temperature ranges of the hot rough-rolling step and the warm finish-rolling step, in particular the starting temperature of the warm finish-rolling step is such that the rectified effect in the warm finish-rolling step is ensured with respect to the rolled-gear to advantageously ensure the accuracy of the rolled-gear.

Also, in the third aspect of the present invention, since the warm finish-rolling step is continuously carried out and immediately after the hot rough-rolling step, the temperature in the vicinity of the teeth produced during the hot rough-rolling step can be appropriately maintained. Thus, on the basis of the lingering heat in the rolled-gear immediately following the hot rough-rolling step, the warm finish-rolling step may be effectively carried out.

Further, since the warm finish-rolling step is continuously carried out immediately after the hot rough-rolling step without the reset of the rolled-gear, the axial aberration due to any reset of the rolled-gear is avoided, and accuracy of the rolled-gear is advantageously improved.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which form a part of the disclosure.

DETAILED DESCRIPTION OF PREFERRED EMBODIMENTS

A Preferred Embodiment of a process for gear-rolling a high accuracy gear according to the present invention will be hereinafter described with reference to the accompanied drawings.

Configurations of the Embodiment

Configurations of the present invention will be hereinafter described.

1. Configurations

Figure 1:
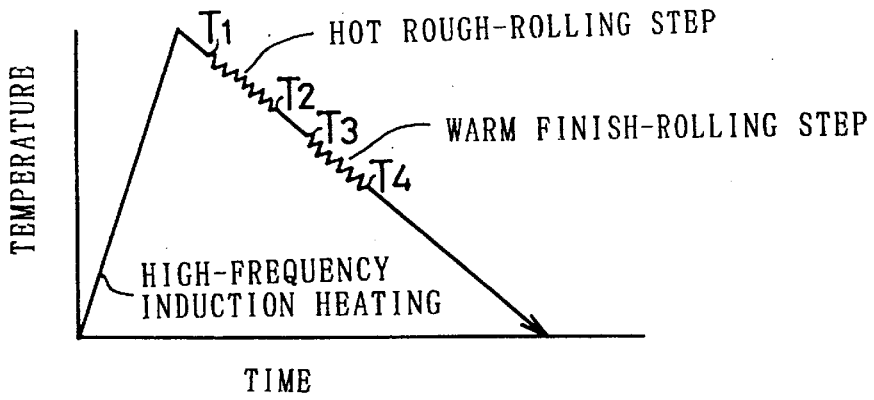
FIG. 1 is a graph depicting the relationship between temperature of a blank and time in a continuous gear-rolling embodiment of the present invention.
Figure 2:
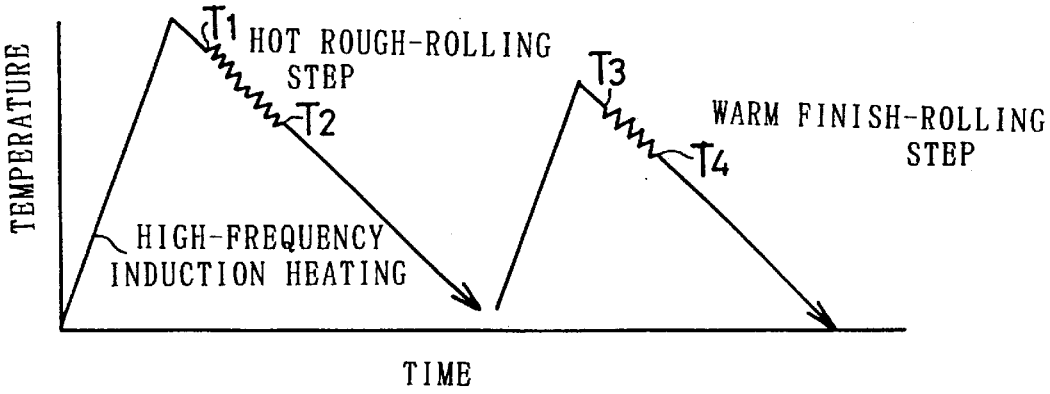
FIG. 2 is a graph depicting the relationship between temperature of a blank and time in a non-continuous gear-rolling embodiment of the present invention.

According to the present invention, a continuous configuration shown in FIG. 1 and a non-continuous configuration shown in FIG. 2 can be employed.

In the continuous configuration show in FIG. 1, an iron-based workpiece, heated by means of high-frequency induction heating, is used. The warm finish-rolling step is continuously carried out immediately after the hot rough-rolling step by employing the residual heat in the rolled-gear without decreasing the temperature to a normal temperature region.

In the non-continuous configuration shown in FIG. 2, the rolled-gear is cooled to a normal temperature immediately after the hot rough-rolling step. Thereafter, the rolled-gear is again heated to warm-temperatures by means of high-frequency induction heating, and the warm finish-rolling step is carried out with respect to the rolled gear.

2. Set Temperature

Set temperature and its significance in the continuous configuration shown in FIG. 1 and the non-continuous configuration shown in FIG. 2 will be hereinafter described with the following (A) through (C):

(A) As for the temperature for heating the outer circumferential portion of the blank, that is the workpiece, in the induction-heating step, the circumferential portion being from 1 to 2 times expected tooth-height, is heated in the range 900° to 1150° C. The temperature of the central portion of the workpiece remains lower, generally from 50° to 200° C., due to skin-effect of the induction heating.

Figure 3A:
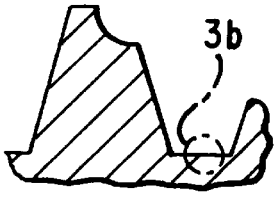
FIG. 3A–3B illustrate defects generated in the case where temperature is inadequate.
Figure 3B:
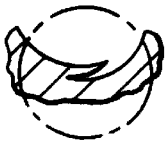

(B) The starting temperature $T_1$ in the hot rough-rolling step is set in the range 850° to 1100° C. When the starting temperature $T_1$ is lower, rise-shortage to the tooth crest occurs because of the poor-fluidity in the plastic deformation. See FIGS. 3A and 3B. Additionally, burr-defects may occur in the deddendum.

Figure 4:
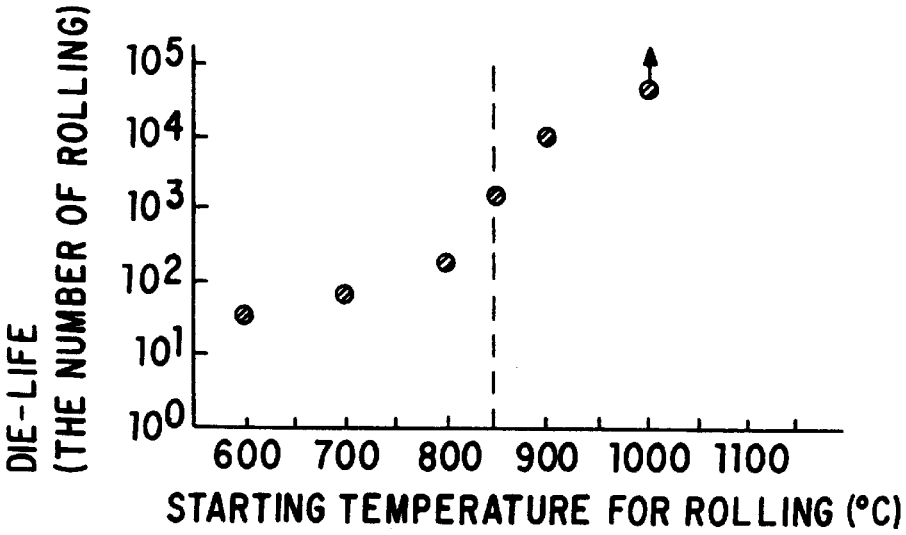
FIG. 4 is a graph which depicts the relationship between starting temperature and die-life (the number of rolling)

As can be observed from test-results depicted in FIG. 4, the lower the starting temperature for rolling, the lower the die-life of the roller die. Conversely, the higher the starting temperature of the blank, the greater the die-life of the roller die. This results from the blank becoming softer at higher temperature, and therefore easier to form, resulting in reduce wear on the roller die. From this point of view, the lower limit of the starting temperature $T_1$ in the hot rough-rolling is set at approximately 850° C.

Figure 5:
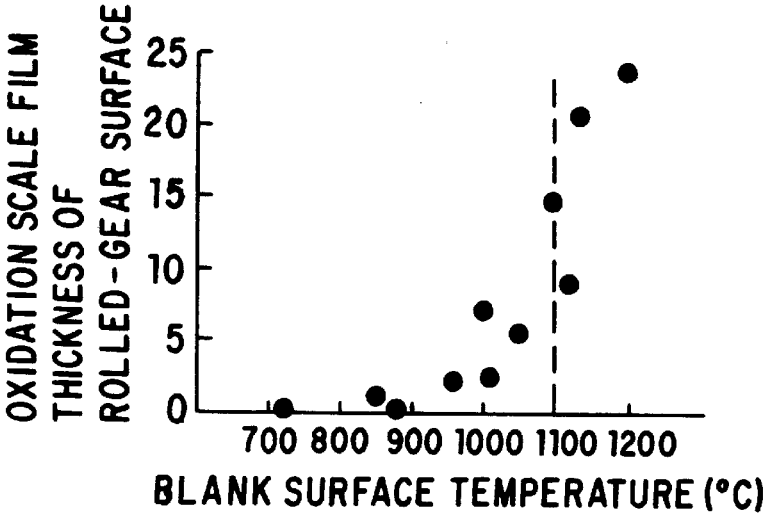
FIG. 5 is a graph which depicts the relationship between blank surface temperature and oxidation scale film thickness of a rolled-gear.

When the starting temperature $T_1$ in the hot rough-rolling step is excessively high, a relatively thick oxidation scale film forms on the surface of blank. See FIG. 5. From this point of view,the upper limit of the starting temperature $T_1$ in the hot rough-rolling is set at approximately 1100° C.

The terminating temperature $T_2$ in the hot rough-rolling step is set in the range of approximately 500° to 700° C. When the terminating temperature $T_2$ is below this range, the appropriate starting temperature of the warm finish-rolling step cannot be obtained. When the terminating temperature $T_2$ is excessively higher, it is required that the starting temperature $T_1$ in the hot rough-rolling step must be set at the temperature region considerably exceeding 1100° C., resulting in the undesirable formation of a thick oxidation scale film. This results in the terminating temperature $T_2$ in the hot rough-rolling step to be set in the range of from approximately 500° to 700° C.

Further, since the temperature of rolling portion in the blank passes the transformation point $A_1$ during rolling, the structure-refining effect can be expected on the basis of the thermomechanical treatment.

(C) The starting temperature $T_3$ in the warm finish-rolling step is set in the range of approximately 400° to 700° C. Any rectification effect is small when the starting temperature $T_3$ is substantially below 400° C.

Not only rectifying the tooth-surface of the rolled-gear, but also rectifying the tooth-groove runout and the accumulative error is increasingly difficult in the range below approximately 400° C. as can be understood from the test-results depicted in FIG. 7. Therefore the starting temperature $T_3$ is set at approximately 400° C.

When the starting temperature $T_3$ in the warm finish-rolling is excessively high, heat-contraction is increased resulting from temperature-factors during cooling, minimizing the burnishing effect at the tooth-surface produced by finish-rolling step. From this point of view, the upper limit of the starting temperature $T_3$ in the warm finish-rolling is set at approximately 700° C.

The terminating temperature $T_4$ in the warm finish-rolling step is set in the range of from approximately 200° to 650° C. When the terminating temperature $T_4$ is significantly lower, the rectifying effect cannot be obtained in the finish-rolling step. When the terminating temperature $T_4$ is significantly higher, heat-contraction resulting from temperature-factors increases during cooling, minimizing the burnishing effect at the tooth-surface produced by finish-rolling. From this point of view, the terminating temperature $T_4$ in the warm finish-rolling is set in the range of from approximately 200° to 650° C.

As can be understood from the aforementioned, each of the temperatures $T_1$, $T_2$, $T_3$, $T_4$ is set to predetermined temperature bands. On condition that these temperature bands are kept, the aforementioned upper limit temperatures can be decreased by 5°, 10°, or 15° C. depending on the rolling conditions in order that the temperature bands may be narrowed. The applied temperature band may vary as required by the composition of the workpiece, for example, carbon content.

3. Engagement Configuration

FIG. 6 schematically depicts an engagement configuration of the workpiece between the roller dies.

Figure 6A:
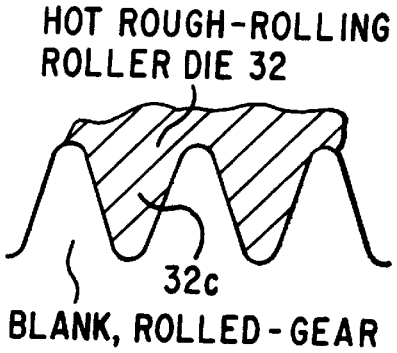
FIG. 6A is a constructive view which illustrates the engagement of the roller die.
Figure 6B:
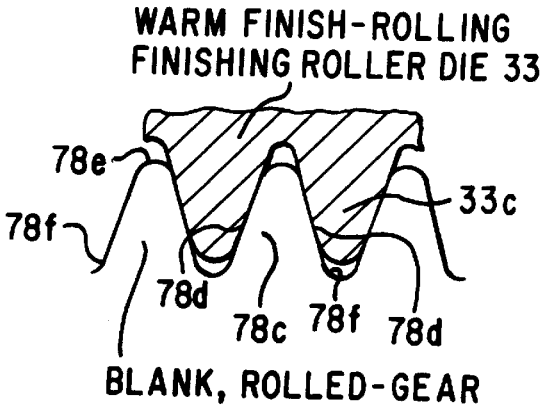
FIG. 6B is a constructive view which illustrates the engagement of the finishing roller die.

As can be seen in FIG. 6(A), the forming teeth 32C of the roller die 32 used in the hot rough-rolling step corresponds to the teeth of the rolled-gear with die-symmetry. In contrast, as can be seen from FIG. 6(B), the forming teeth 33*c* of the finishing roller die 33 used in the warm finish-rolling step does not correspond to the teeth 78*c* of the rolled-gear with die-symmetry. In FIG. 6(B), although burnishing work in carried out on the teeth-surface 78*d* of the teeth 78*c* of rolled-gear, the burnishing work is not carried on the tooth-crest 78*e* and tooth-flank 78*f*, because the tooth-crest 78*c* and tooth-flank 78*f* do not come into contact with the forming teeth 33*c* of the finishing roller die 33.

4. Experiments

Figure 7:
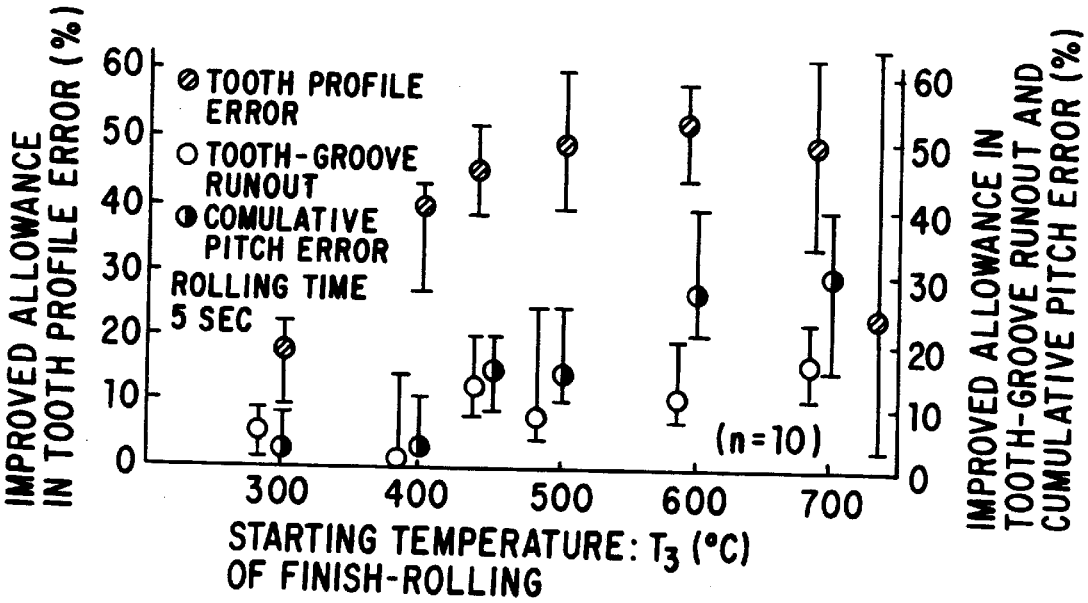
FIG. 7 is a graph which depicts the relationship between starting temperature of the finish-rolling step and the improved allowances in tooth profile error, tooth-groove runout, and the cumulative pitch error.

FIG. 7 shows the relationship between the accuracy of the rolled-gear and the starting temperature $T_3$ of the warm finish-rolling step. The left side of the vertical axis in FIG. 7 shows the improved allowance of tooth profile error, and the right side of the vertical axis in FIG. 7 shows the improved allowance of tooth-groove runout and the improved allowance of accumulative pitch error.

The improved allowance is exhibited as follows:

$$\frac{\text{(the dimension accuracy difference between before and after finish-rolling step)}}{\text{(the dimension acuracy difference before finish-rolling step)}} \times 100\%$$

The larger the improved allowance, the larger the rectified effect is. The hatched mark in FIG. 7 shows the tooth profile error, the circle mark shows the tooth-groove runout, and the half black-painted mark shows the accumulative pitch error. The tooth profile error, the teeth-groove runout, and accumulative error are defined on the basis of JIS-STANDARD.

As understood from the test-results in FIG. 7, when the starting temperature $T_3$ in the warm finish-rolling is more than approximately 400° C., the improved allowance of tooth profile error, the improved allowance of tooth-groove runout, and the improved allowance of the accumulative error are high. In particular, the betterment effect is larger in the improved allowance of tooth profile error. However, when the starting temperature $T_3$ of the warm finish-rolling step is less than approximately 400° C., the rectified effect in accuracy is decreased.

In this experiment, the target rolled-gear was a herical gear where the material of the blank was carbon steel (JIS: S58C), a normal module of the target rolled-gear was set at 2.4, the number of the teeth was set at 10, and a helical angle set at 30 degrees. The number of specimens was 10(n=10). The blank holding portion was used as a flowing system capable of moving in the squeezing direction with the squeezing load applied from right and light. In the hot rough-rolling step, the starting temperature $T_1$ was set at 950° C., and the terminating temperature was set at 650° C. Each of the squeezing load of a pair of roller squeezing apparatus was set at 5 tonf, the time for squeezing operation was 3.5 seconds, and the time for sizing operation was 3.5 seconds.

After the hot rough-rolling step was carried out on the basis of the aforementioned conditions, the warm finish-rolling step (the starting temperature $T_3$=600° C., the terminating temperature $T_4$=450° C.) was carried out on the basis of the configuration shown in FIG. 2 to form the rolled-gear.

The tooth profile was measured.

Figure 8B:
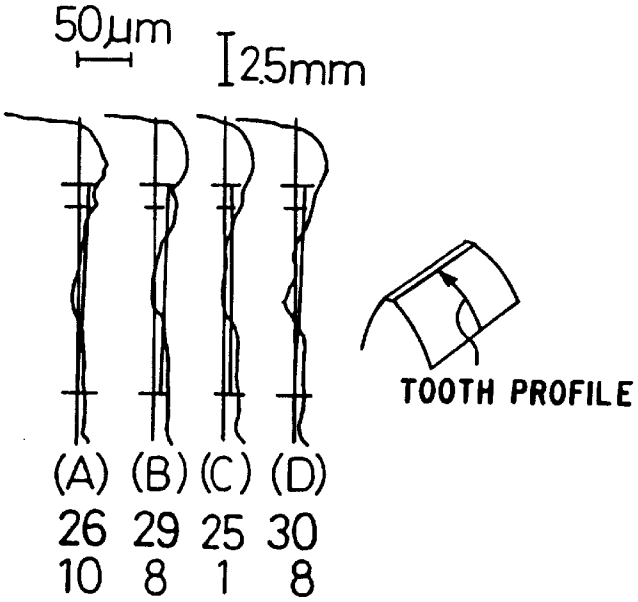
FIGS. 8A–8B are profile views which depict the tooth profiles before the warm finish-rolling step.
Figure 8A:
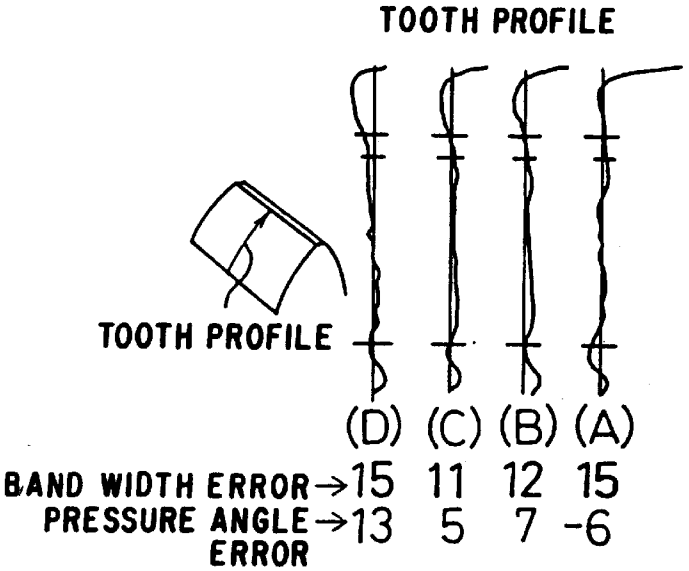
Figure 9B:
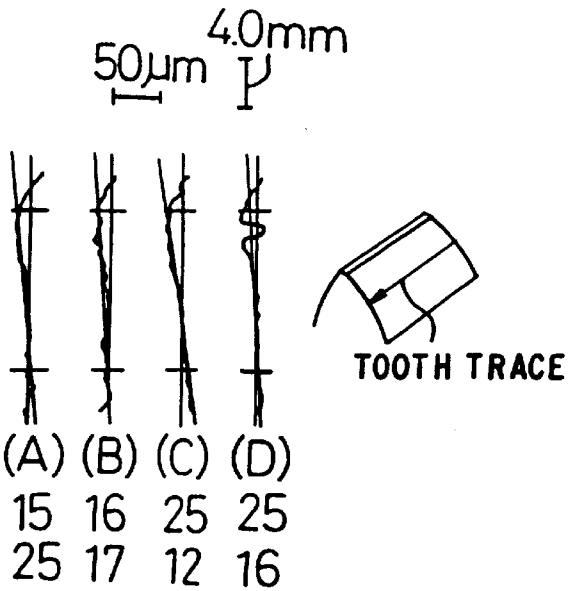
FIGS. 9A–9B are profile views which depict the tooth trace profiles before the warm finish-rolling step.
Figure 9A:
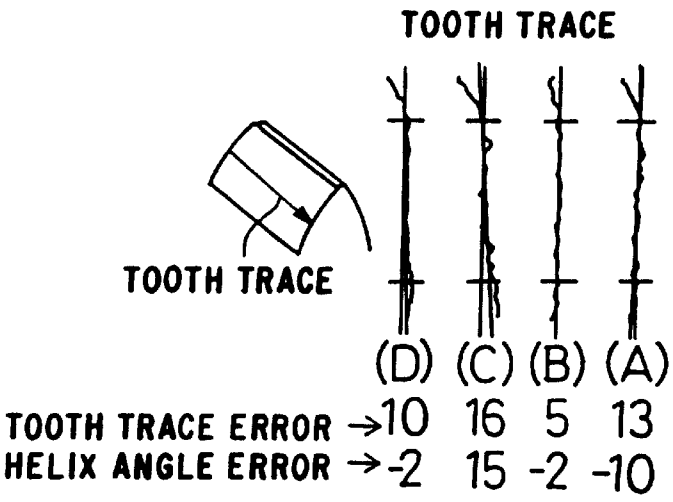

FIGS. 8A–8B show tooth profiles (A) to (D) disposed at intervals 90° in the circumferential direction along opposite sides of a tooth, and which belong to the rolled-gear before the warm finish-rolling step. Additionally, FIGS. 9A–9B show tooth trace profiles (A) to (D) for the same tooth depicted in the tooth profiles in FIGS. 8A–8B. The combination of (A) and (A) shows the tooth-surface being back to back with each other in the specific one tooth. The combination of (B) and (B) shows the tooth-surface being back to back with each other in the specific other tooth. The combination (C) and (C) is similar. Also, the combination (D) and (D) is similar.

In FIGS. 8A–8B, the portions below the drawn profiles shows the band width error (unit: micron) and the pressure angle error (unit: micron). In FIGS. 9A–9B, the portion below the drawn profiles shows the tooth trace error (unit: micron) and helix angle error (unit: micron).

Figure 10B:
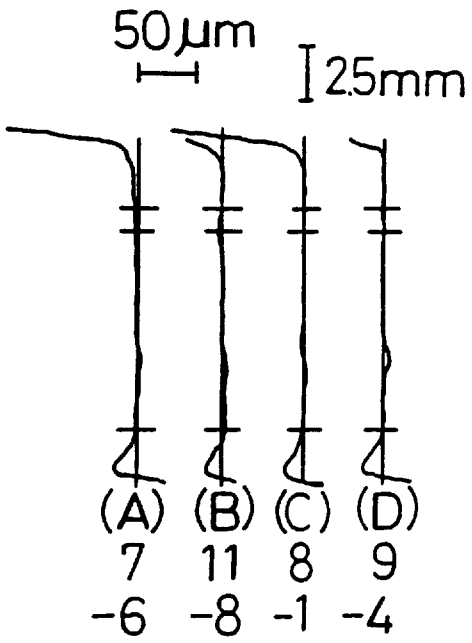
FIGS. 10A–10B are profile views which depict the tooth trace profiles after the warm finish-rolling step.
Figure 10A:
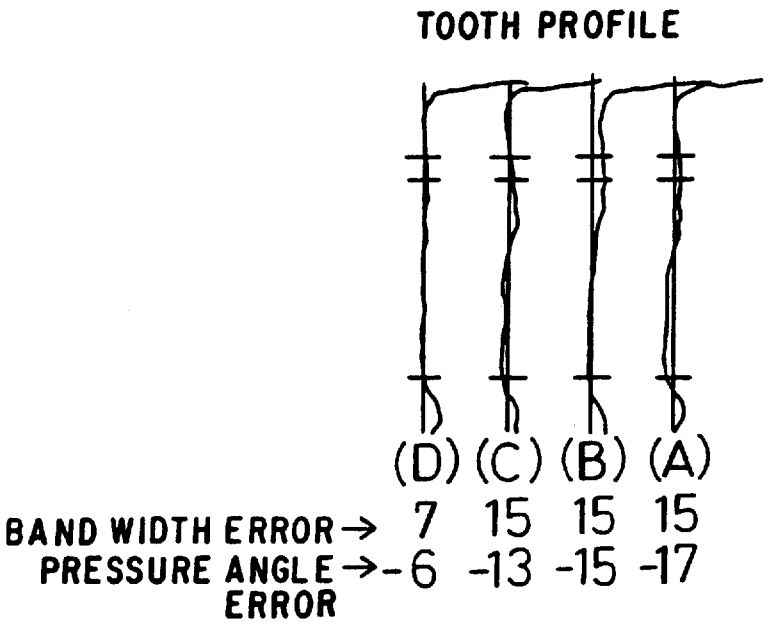
Figure 11B:
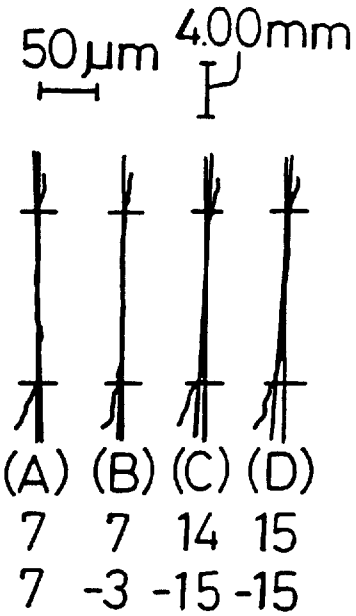
FIGS. 11A–11B are profiles views which depict the tooth trace profiles after the warm finish-rolling step.
Figure 11A:
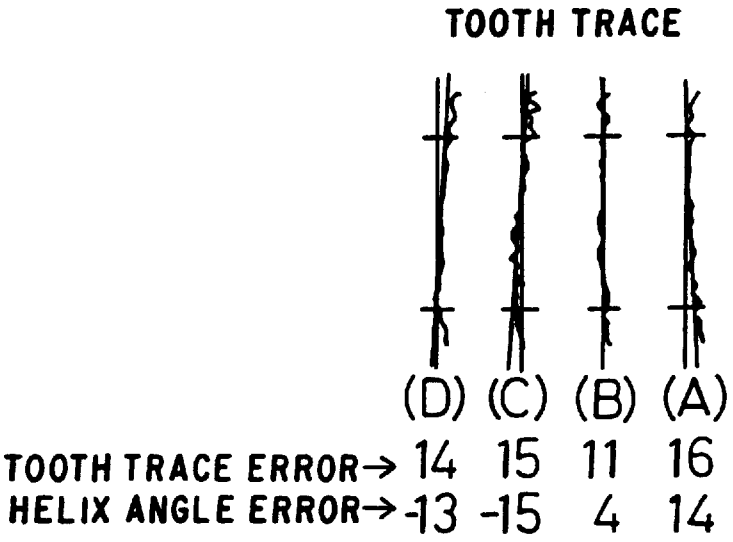

FIGS. 10A–10B depict the tooth profiles after the warm finish-rolling step, and FIGS. 11A–11B depict tooth trace profiles after the warm finish-rolling step. Also, FIGS. 10A–10B depict the band width error and, the pressure angle error, and FIGS. 11A–11B depict the tooth trace error, and the helix angle error.

As can be understood from a comparison between FIGS. 8A–8B and 10A–10B, the betterment effect is seen in the band width error and the pressure angle error. Further, as can be understood from a comparison between FIGS. 9A–9B and 11A–11B, the betterment effect is seen in the tooth trace error and the helix angle error.

Figure 12A:
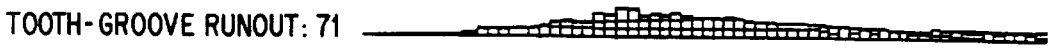
FIGS. 12A–12C are profile views which depict the tooth-groove runout and the cumulative pitch error (Right, R and Left, L) before the warm finish-rolling step.
Figure 12B:
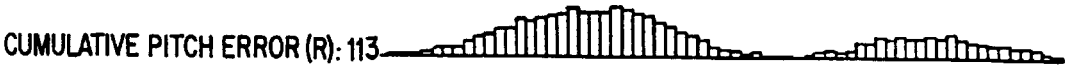
Figure 12C:
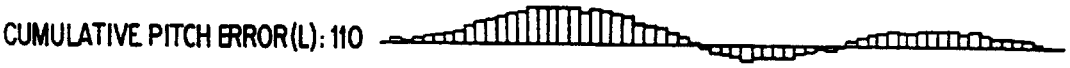
Figure 13A:
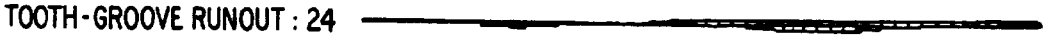
FIG. 13A–13C are profile views which depict the tooth-groove runout and the cumulative pitch error (Right, R and Left, L) after the warm finish-rolling step.
Figure 13B:
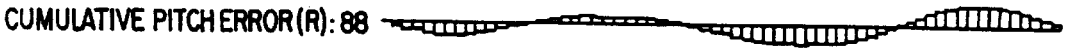
Figure 13C:
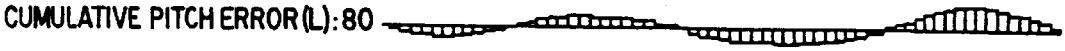

Moreover, FIGS. 12A–12C depict the tooth-groove runout and the cumulative pitch error (Right, R and Left, L) before the warm finish-rolling step. FIGS. 13A–13C depict the tooth-groove runout and the cumulative pitch error (Right, R and Left, L) after the warm finish-rolling step. Although the tooth-groove runout is 71 microns before the finish-rolling step, it is decreased to 24 microns after the finish-rolling step. Although the cumulative pitch error (R) is 113 microns before the finish-rolling step, it is decreased to 88 microns after the finish-rolling step. Although the cumulative pitch error (L) is 110 microns before the finish-rolling step, it is decreased to 80 microns after the finish-rolling step.

According to the present invention, not only iron-based but also other materials are used as the material of the workpiece. Heating means capable of heating the workpiece to high temperatures at a rapid rate may be used as the heating means other than induction heating.

Figure 14:
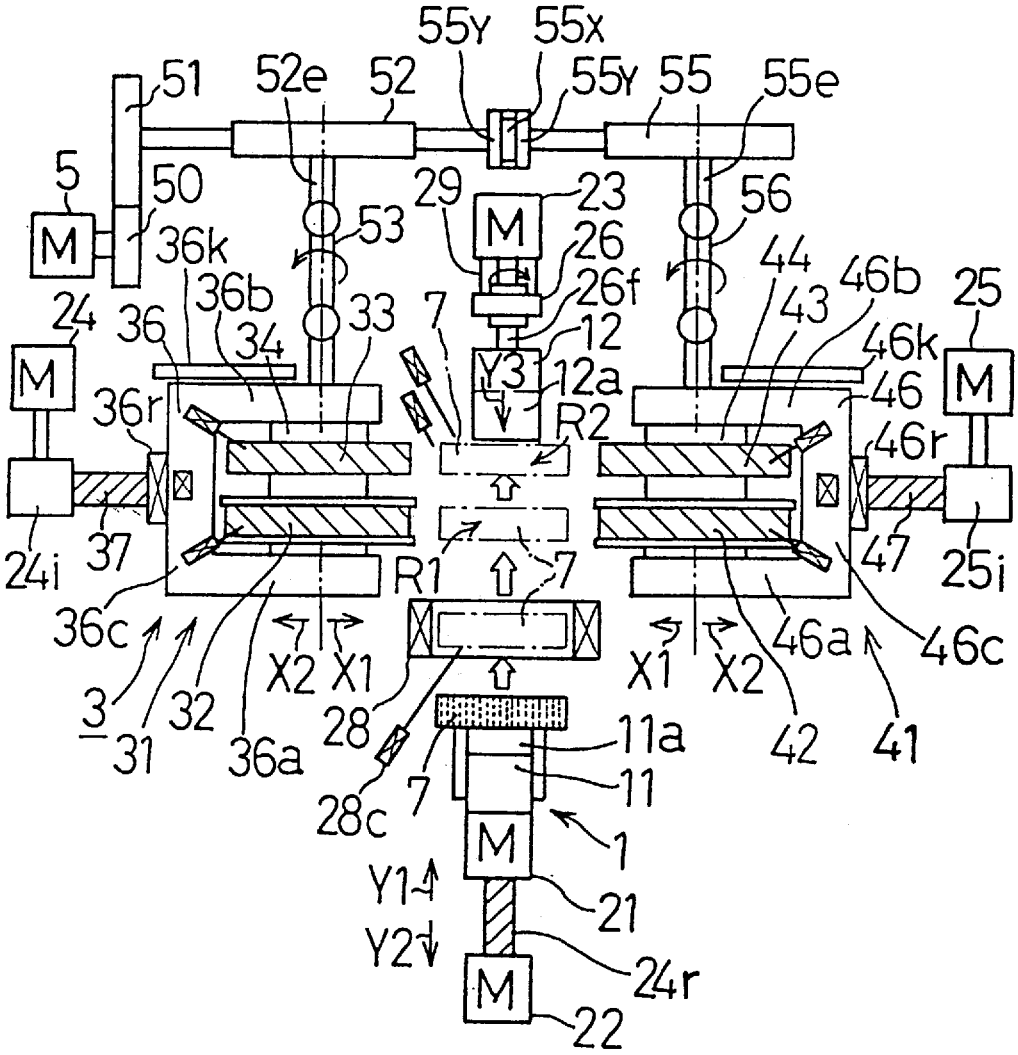
FIG. 14 is a plan view schematically illustrating the gear-rolling apparatus of the Preferred Embodiment.
Figure 15:
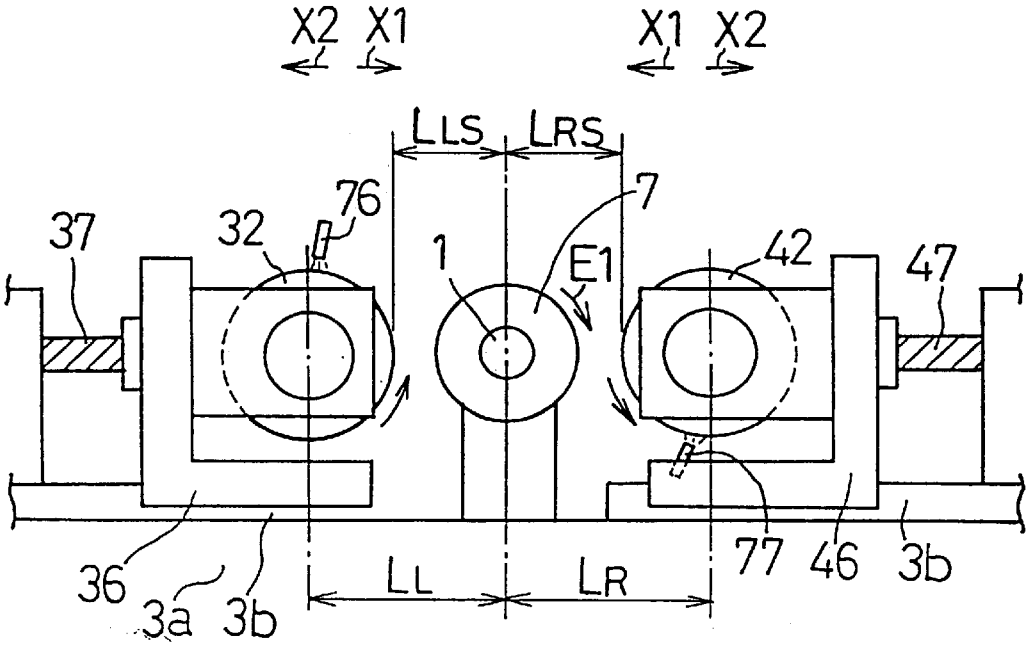
FIG. 15 is a front view which illustrates the gear-rolling apparatus of the Preferred Embodiment.

For the next embodiment the apparatus will be described with reference to FIGS. 14 through 21. FIG. 14 illustrates the plan view of the inventive apparatus. FIG. 15 illustrates the front view of the major portion of the apparatus.

As can be seen from FIG. 14, a blank holding portion 1, which operates as a workpiece holding portion, comprises a first blank holding portion 11 and a second blank holding portion 12 facing each other. The first blank holding portion 11 includes a first blank holding shaft 11*a* having a large-diameter, and the second blank holding portion 12 includes a second holding shaft 12*a* having a large-diameter.

A first motor 21 operates as a blank rotating means for operating the blank, that is, the workpiece. When the first motor 21 drives, the first blank holding portion 11 rotates in a circumferential direction thereof (i.e., the direction of the arrow "E1" in FIG. 15).

In FIG. 14, there is disposed a second motor 22 for moving the first blank holding portion 11 to transfer the blank. When the second motor 22 drives, a ball screw shaft 24*r* rotates in a circumferential direction thereof, and thereby the first blank holding portion 11 and the blank 7 are transferred in directions of arrow "Y1", "Y2".

In FIG. 14, when a third motor 23 operates as a blank rotating means drives, the second blank holding portion 12 rotates by way of a torque transmitting variable clutch 26 (for instance, a powder clutch) in a circumferential direction thereof, namely, the same direction as the rotating direction of first blank holding portion 11. When a hydraulic cylinder 29 for transferring the second blank holding portion 12 drives, the second blank holding portion 12 is transferred toward the first blank holding portion 11 in the direction of the arrow "Y3" by use of the ball-splined shaft 26*f*, and thereby the second blank holding portion 12 and the first blank holding portion 11 can hold the blank 7 forcibly.

In FIG. 14, on the other side of the first blank holding portion 11, there is disposed a high-frequency heating coil 28 which operates as a ring-shaped heating means for heating the blank 7 by means of induction-heating. A thermal sensor 28*c*, for example, a radiation pyrometer, detects situations of the heated blank.

A roller squeezing apparatus 3 includes a first roller squeezing apparatus 31 and a second roller squeezing apparatus constituting a pair for holding the blank 7 in the radius direction of the blank 7. The first roller squeezing apparatus 31 comprises a first roller die 32 for working as a hot rolling tool, a first finishing roller die 33 for working as a warm rolling tool, a first connecting shaft 34, and a first housing 36. The first connecting shaft 34 connects the first roller die 32 and the first finishing roller die 33 in series along the axial direction and coaxially. The first roller die 32 and the first finishing roller die 33 are rotatably held on the first housing 36. Further, the first roller squeezing apparatus 31 includes a fourth motor 24 and a first ball screw shaft 37.

As can be seen from FIG. 14, similarly, the second roller squeezing apparatus 41 comprises a second roughing roller die 42 for working as a hot rolling tool, a second connecting shaft 44, and a second housing 46.

The second connecting shaft 44 connects the second roller die 42 and the second finishing roller die 43 in series in the axial direction and coaxially. The second roller die 42 and the second finishing roller die 43 are rotatably held on the second housing 46. Further, the second roller squeezing apparatus 41 includes a fifth motor 25 and a second ball screw shaft 47.

The first housing 35 is capable of squeezing the blank 7 in the direction of the arrow "X1" and is capable of withdrawing from the blank 7 in the direction of the arrow "X2". The second housing 46 is capable of squeezing the blank 7 in the direction of the arrow "X1" and is capable of withdrawing from the blank 7 in the direction of the arrow "X2".

As can be understood from FIG. 14, the first housing 36, having a "channel-shape" in a plan view, includes two first faced thick-wall portions 36*a*, 36*b* facing each other, and a first connecting thick-wall portion 36*c* for connecting the first faced thick-wall portion 36*a*, 36*b*. Also, the second housing 46, having a "channel-shape" in a plan view, includes two second faced thick-wall portions 46*a*, 46*b* facing each other, and a second connecting thick-wall portion 46*c* for connecting the second faced thick-wall portions 46*a*, 46*b*.

As can be understood from FIG. 15, the first housing 36 and the second housing 46 are movable along the guiding portions 3*b* fixed on the base 3*a* for supporting themselves in the directions of the arrow "X1" "X2".

Turning back to FIG. 14, when the fourth motor 24 is driven, the driving force of the fourth motor 24 is reduced by use of the first speed reducer 24*i* and is transmitted to the first ball screw shaft 37. Then, the first ball screw shaft 37 is rotated in the circumferential direction, and the first housing 36 is transferred in the direction of the arrow "X1"; hence, the first roller die 32 and the first finishing roller die 33 which are held on the first housing 36 are transferred toward the blank 7 in the same direction.

Also, when the fourth motor 24 is conversely rotated, the first ball screw shaft 37 is conversely rotated in the circumferential direction thereof, and thereby the first housing 36 is transferred in the direction of the arrow "X2". Accordingly, the first roller die 32 and the first finishing roller die 33 are transferred together in the same direction to be withdrawn from the blank 7. Hence, the fourth motor 24 and the first ball screw shaft 37 operate as squeezing and withdrawing means for squeezing the first roller die 32 and the first finishing roller die 33 toward the blank 7.

Similarly, in FIG. 14, when the fifth motor 25 is driven, the driving force of the fifth motor 25 is reduced by use of the second speed reducer 25*i* and is transmitted to the second ball screw shaft 47. Then, the second ball screw shaft 47 is rotated in the circumferential direction thereof, the second housing 46 is transferred in the direction of the arrow "X1"; hence, the second roller die 42 and the second finishing roller die 43 are transferred toward the blank 7 in the same direction.

When the fifth motor is conversely rotated, the second ball screw shaft 47 is conversely rotated in the circumferential direction, and thereby the second housing 46 is transferred in the direction of the arrow "X2". Accordingly, the second roller die 42 and the second finishing roller die 43 are transferred together in the same direction to be withdrawn from the blank 7. Hence, the fifth motor 25 and the second ball screw shaft 47 operate as squeezing means for squeezing the second roller die 42 and the second finishing roller die 43 toward the blank 7.

The load working on the first housing 36 is detected by use of a first load cell 36*r*, and a transferred amount of the first housing 36 is detected by use of a first liner scale 36*k*. The load working on the second housing 46 is detected by use of a second load cell 46*r*, and a transferred amount of the second housing 46 is detected by use of a second liner scale 46*k*. Each of the detected signals is inputted to a controller system.

The aforementioned fourth motor 24 and fifth motor 25, constituting a servo-motor respectively, are controlled on the basis of squeezing synchronous command signals and withdrawing synchronous command signals from the controller system, and thereby operating the first ball screw shaft 37 and the second ball screw shaft 47 synchronously. Accordingly, the first roller die 32 and the second roller die 42 can be synchronously squeezed in the direction of the arrow "X1" and can be synchronously withdrawn in the direction of the arrow "X2".

Also, in FIG. 14, when the motor 5 constituting the servo-motor for rotating the dies is driven on the basis of driving command signals from controller system, the first reducer 52 is worked by way of gears 50,51 for reducing speed. Then, the first connecting shaft 34, the first roller die 32, and the first finishing roller die 33 are rotated together by way of the rotating shaft 52*e* and the first constant speed universal joint 53, and thereby the rolling step is carried out.

Moreover, the driving force of the motor 5 for rotating the first die is transmitted to a phase adjusting mechanism 55*x*, a second reducer 55, a rotating shaft 55*e*, and a second constant speed universal joint 56. Accordingly, the driving force of the motor 5 is transmitted to the second connecting shaft 44, the second roller die 42, and the second finishing roller die 43; therefore, they are rotated.

The phase adjusting mechanism 55*x* is used for adjusting the circumferential phase of the forming teeth of the first roller die 32 to the circumferential phase of the forming teeth of the second roller die 42. The phase adjusting mechanism 55*x* has a function for canceling the phase-difference between the first roller die 32 and the second roller die 42. With the object of realizing this function, the phase adjusting mechanism 55*x* has a pair of disks 55*y* including a lot of engaging teeth extending in a radial direction and connecting means for connecting the disks 55*y*. Controlling the engagement between the engaging teeth of the disks 55*y* realizes that function.

Figure 16:
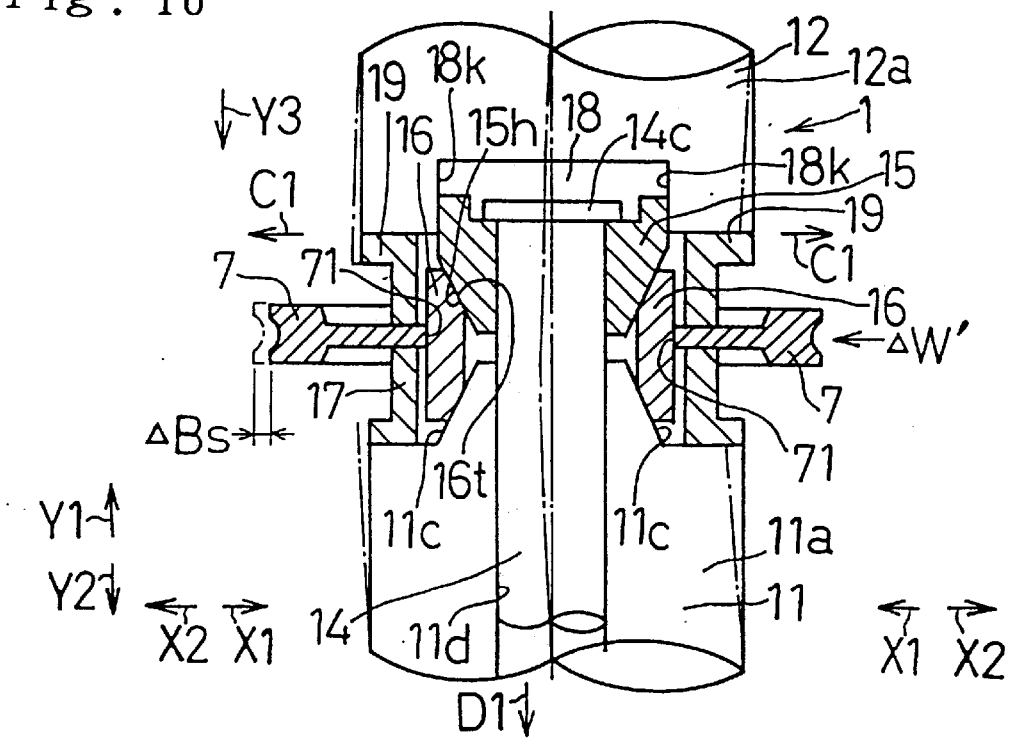
FIG. 16 is a constructive view which illustrates a construction of a blank holding portion.

The holding mechanism of the blank holding portion 1 will be described hereinafter. As shown in FIG. 16, the first blank holding portion 11 includes a first holding shaft lla, an operating shaft 14, a tightening body 15 having a sleeve-shape, a collet 16, and a pressing body 17 having a ring-shape. The first holding shaft 11*a*, having high rigidity, includes a first conical surface 11*c* having a reducing outer diameter as it goes to an axial end. The operating shaft 14 is slidablely inserted in an inserting hole *d* of the first holding shaft 11*a*. The tightening body 15 is disposed at the end of the first holding shaft 11*a* to be engaged with a flange 14*c* positioned at the axial end of the operating shaft 14. The collet 16 operates as an engaging claw capable of moving in the direction of the arrow "C1", namely, the radius outward direction. The pressing body 17 is held at the end surface of the first holding shaft 11*a* by use of bolts (not shown).

In FIG. 16, when the operating shaft 14 is operated in the direction of the arrow "D1", the tightening body 15 is moved in the same direction. Thus, the conical surface 15*h* of the tightening body 15 pushes a conical surface 16*t* of the collet 16 forcibly. As a result, the collet 16 is moved in the direction of the arrow "C1", and the collet 16 urges the inner wall surface 71 constituting the central hole of the blank 7 in the direction of the arrow "C1", and thereby the blank 7 is firmly held by use of the first blank holding portion 11.

The second blank holding portion 12 comprises an inserting bore 18 formed at the axial end thereof and a ring-shaped pressing body 19 held with bolts (not shown) at the axial end. A guiding wall surface 18*k* with a slight inclination is formed at the inner surface of the inserting bore 18.

When the first blank holding portion 11 and the second blank holding portion approach each other relatively along the axial direction, as can be understood in FIG. 16, the inserting bore 18 of the second holding shaft 12*a* of the second blank holding portion 12 is forcibly inserted into the tightening body 15, thereby restricting movement of the tightening body 15 in the radial direction. This results in the first blank holding portion 11 and the second holding portion 12 holding the blank 7 securely. Therefore, the blank 7, which is held by use of the first blank holding portion 11 and the second holding portion 12 utilizing a locking method, cannot fluctuate substantially in the directions of the arrow "X1,X2".

Blank Holding Rigidity

In this embodiment, the blank holding rigidity is set more rigid than 0.1 mm/tonf in the direction of the arrow "X1", the squeezing direction, with typical ranges from approximately 0.01 to 0.085 mm/tonf, and from approximately 0.07 to 0.08 mm/tonf.

The aforementioned blank holding rigidity on the basis of the blank holding portion 1 is defined as follows:

As shown as an imaginary line in FIG. 16, it is supposed that the first holding shaft 11*a* and the second holding shaft 12*a* are bent due to unbalanced force ΔW' to generate the deflection ΔBs of the blank 7 in the directions of the arrow "X1,X2", that is, the squeezing direction, for comprehension of them, the imaginary line draws an exaggerated deflection.

In the case where the blank holding rigidity is indicated as $E_B$ $$E_B=\{\Delta B_s(mm)/\Delta W'(tonf).$$

In order that the blank holding rigidity $E_B$ is more rigid than 0.1 mm/tonf, (A) A rickety movement, existing between the outer wall surface of the collet 16 and the inner wall surface 71 of the blank 7, approaches zero; and (B) The rigidity of the first holding shaft 11*a* of the first blank holding portion 11 and the second holding shaft 12*a* of the second blank holding portion 12 is more rigid in the squeezing direction (i.e., the directions of the arrow "X1, X2").

For realizing the above-mentioned (A)(B), the following (a) through (e) are important:

(a) Increasing the diameter of the first holding shaft 11*a* and the second holding shaft 12*a;*

(b) Thickening the first housing 36 and the second housing 46;

(c) Increasing the number of reinforcing ribs for enlarging the rigidity of the housing 36,46;

(d) Selecting the material having high-rigidity as a base metal of the housing 36,46;

(e) Setting the rickety movement of the sliding surface for transferring the housing 36,46 to zero by way of a locking mechanism such as a hydraulic pressure mechanism.

Squeezing Synchronous Precision

The squeezing synchronous precision means an average deflection in a squeezed amount of the first roller die 32 and the second roller die 42 during the rolling step when both of the roller dies 32,42 are synchronously squeezed with respect to the blank 7.

In this embodiment, the squeezing synchronous precision L between the first roller die 32 and the second roller die 42 is set greater than 0.03 mm in the direction of the arrow "X1", the squeezing direction. Concretely, it is set in the range from approximately 0.005 to 0.03 mm. In this embodiment, not only the squeezing synchronous precision between the first roller die 32 and the second roller die 42, but also the squeezing synchronous precision between the first finishing roller die 33 and the second finishing roller die 43 is the aforementioned range.

The squeezing synchronous precision is expressed as follows: In FIG. 15, the distance between the outer end of the first roller die 32 for contacting the blank 7 and the central axial line of the blank holding portion 1 is indicated as $L_{LS}$ (mm). The distance between the outer end of the second roller die 42 for contacting the blank 7 and the central axial line of the blank holding portion 1 is indicated as $L_{RS}$ (mm). The affixed "S" in "$L_{LS}$" and "$L_{RS}$" means the outer end of the roller die.

Squeezing synchronous precision as a moment value at a certain time is indicated as ΔL', ΔL', means an absolute value of the difference between the squeezed amount of the first roller die 32 and a squeezed amount of the second roller die 42 at the certain time, such that $\Delta L' = |L_{LS} - L_{RS}|$ As the aforementioned ΔL' is a moment value, it varies from the start to the finish in the rolling step; therefore, the average value of the aforementioned moment values ΔL' is determined as the squeezing synchronous precision ΔL in the present invention.

Additionally, ΔL' is under the influence of the original feeding precision on the basis of the roller squeezing apparatus 3 in the no-load condition and a bending amount of the roller squeezing apparatus 3 during the rolling step.

The aforementioned squeezing synchronous precision having high precision is achieved as follows: As shown in FIG. 14, the ball-screw system having the accurate ball screw shafts 37, 47 is employed, and the servo-controlled system operating the ball screw shafts 37,47 synchronously by way of the motors 24,25 operating as servo-motor is employed. A combination of these systems shows that the feeding precision for transferring the first roller die 32 and the second roller die 42 in the squeezing direction is improved, and the rigidity of the roller squeezing apparatus 3 is high.

Rigidity of the Roller Squeezing Apparatus

Figure 17:
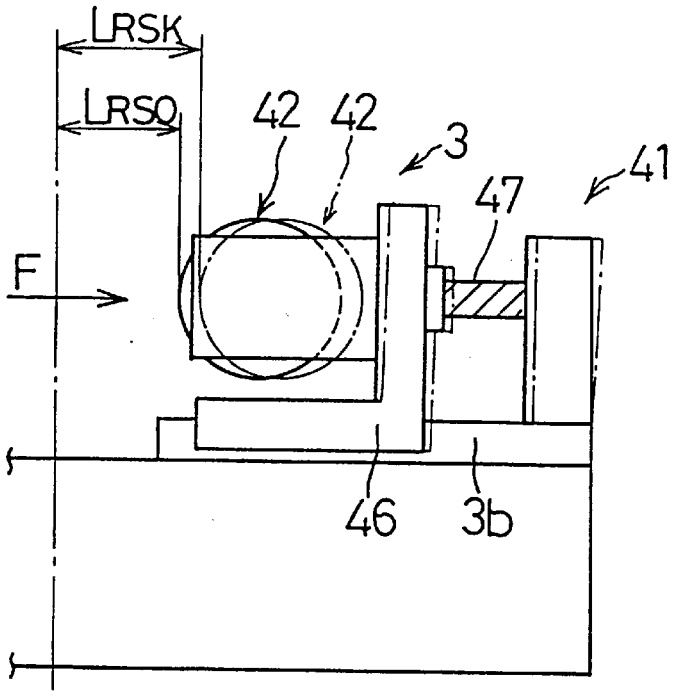
FIG. 17 is a constructive view which depicts the rigidity in a squeezing direction of the roller squeezing apparatus.

In this embodiment, the rigidity of the roller squeezing apparatus 3 is set in the region more rigid than 0.03 mm/tonf, and is set in the range from approximately 0.033 to 0.01 mm/tonf. The rigidity of the roller squeezing apparatus 3 is defined as follows: As shown in FIG. 17, $L_{RSO}$ (mm) indicates the distance from the central axial line of the blank holding portion 1 to the outer end of the roller die 42 under no-load. When load "F" is applied to this apparatus, $L_{RSK}$ (mm) indicates the distance of the central line of the blank holding portion 1 to the outer end of the roller die 42.

Here, the rigidity of the roller squeezing apparatus 3 is indicated as $E_R$, $$E_R(mm/tonf) = \{(L_{RSK} - L_{SRO})/F\}$$

In FIG. 17, the deflection is exaggeratingly drawn by use of the imaginary line for comprehension, Phase-Difference between Dies during Rolling In this embodiment, the phase-difference between the first roller die 32 and the second roller die 42 is controlled on the basis of the controller system. The deflection (an average deflection during rolling), existing between the rotating angle of the second roller die 42 and the rotating angle of the first roller die 32 with respect to one rotation of the first roller die 32, is suppressed within approximately 0.1°. This deflection is preferably within approximately 0.03°. This small phase-difference can be advantageously realized on condition that the motor 5 constituting the servo-motor for rotating the die is controlled by use of the controller system (not shown), the phase adjusting mechanism 55*x* is employed, the constant speed universal joints 53,56 having high precision are employed, and a back-lash removing mechanism (not shown) is employed.

Figure 18:
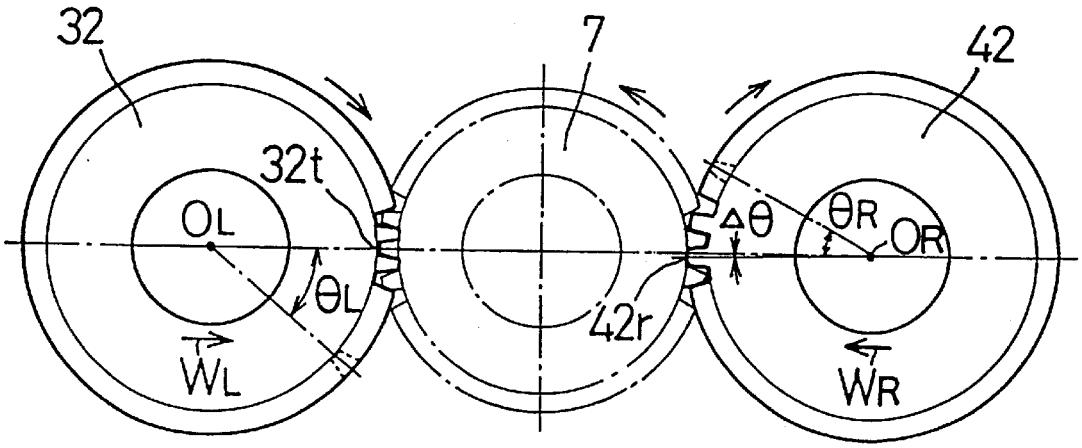
FIG. 18 is a constructive view which illustrates a phase-difference of roller dies.

Taking that the number of the teeth of the rolled-gear is odd numbers as an example, the phase-difference of the dies will be hereinafter explained. As shown in FIG. 18, "$O_L$" indicates the central line of the first roller die 32, while "$O_R$" indicates the central line of the second roller die 42. The "$O_L$–$O_R$" line connects both of the central lines.

When one of the teeth-groove centers 32*t* in the first roller die 32 is disposed on the "$O_L$–$O_R$" line during rolling, and when one of centers 42*r* of the forming teeth in the second roller die 42 is disposed on the "$O_L$–$O_R$" line during rolling, the difference between both the dies approaches 0°.

Here, the phase-difference between both the dies 32,42 during rolling is under influence of the sum adding an initial phase-difference Δθ to a speed dispersion Δθ m in the rotating mechanism. The initial phase-difference Δθ, existing between the first roller die 32 and the second roller die 42, will be hereinafter described as follows: It is requested before rolling that the center 32*t*,42*r* in the roller die 32,42 must be ideally disposed on the "$O_L$–$O_R$" line. In spite of this request, when the center 42*r* of forming teeth in the second roller die 42 is shifted by Δθ with respect to the "$O_L$–$O_R$" line before rolling, the angle Δθ is defined as the initial phase-difference between the first roller die 32 and the second roller die 42.

Moreover, when the first roller die 32 is rotated by rotational angle $\theta_L$, it is ideally requested that the rotational angle $\theta_R$ of the second roller die 42 is equal to θL.

However, $\theta_R$ is not equal to $\theta_l$ on a microscopic level because of the influence of rotational dispersion of the rotational mechanism.

Thus, generally, $\theta_R = \theta_L + \Delta\theta m'$

Here, Δθ 'm is defined as a speed dispersion in the rotational mechanism. Δθ'm is a moment value at a certain time, and varies slightly during rotating. So, in this embodiment, not a moment value but an average value from the starting of the rolling to the terminating of the rolling is defined as the aforementioned Δθm.

In the case where the number of the teeth of the rolled-gear is an even number, one of the teeth-groove of the forming teeth of the first roller die 32 is disposed to face with one of the teeth-groove of the forming teeth of the second roller due 42. In such circumstances, when one of the teeth-groove centers of the first roller die 32 and one of centers of the teeth-groove of the second roller die 42 are disposed on the "$O_L$–$O_R$" line, the phase-difference approaches 0°.

Rolling Process

In FIG. 14, the carbon steel based blank 7 (material; JIS-STANDARD S58C), being kept in a nominal temperature range, is held on the first blank holding portion 11 as previously described. Next, the second motor 22 is driven to transfer the blank 7 in the direction of the arrow "Y1" and to dispose the blank 7 in the high-frequency heating coil 28. The motor 21 is driven to rotate the blank 7 in the circumferential direction (i.e., the direction of the arrow "E1" in FIG. 15). While the blank 7 is rotated, the outer circumferential portion of the blank 7 is induction-heated by use of the high-frequency heating coil 28. The circumferential portion is heated up to approximately 900° C. in the blank 7 is from the outer circumference of the blank 7 to a depth approximately 1.3 times of the expected tooth height. The heating time is set in the neighborhood from seconds to 30 seconds.

When the outer circumferential portion of the blank 7 is heated to the designated temperature range (more than approximately 900° C.), the rolling step is carried out. The time from the termination of the heating step to the start of the hot roughing-rolling step is set to within approximately 5 seconds. The reason is that the heat-transmission into the inside of the blank 7 is suppressed to reduce the increasing of the temperature in the middle portion of the blank 7 for improving a temperature-distribution in the blank 7.

After heating, the ball screw shaft 24*r* is operated by use of the second motor 22, and the blank 7 is transferred in the direction of the arrow "Y1" to be disposed at a forming location "R1" (FIG. 14). At this time, the second blank holding portion 12 is moved in the direction of the arrow "Y3"; thus, both of the second blank holding portion 12 and the first blank holding portion 11 hold the blank 7 forcibly as illustrated in FIG. 16. The force is set to predetermined values of several tonf by use of the hydraulic cylinder 29.

The blank 7 is then rotated in the circumferential direction by the driving force of the third motor 23. During this step the first motor 21 is off, and the blank 7 is rotated only by use of the third motor 23.

Moreover, the first roller die 32 and the second roller die 42 are rotated at a predetermined, relatively constant, speed. On the basis of the squeezing synchronous command signals outputted from the controller system, the first roller die 32 and the second roller die 42 are synchronously squeezed to the outer circumferential portion of the blank 7 in the direction of the arrow "X1" (squeezing speed: approximately 6 mm/sec). Thus, a rise of tooth is generated. After this rise, the sizing are carried out at the outer circumferential portion of the blank 7 during rotations 5–20 of the blank 7, so that the plural teeth are generated during the hot rough-rolling step. After that, on the basis of the withdrawing synchronous command signals received from the controller system, the first roller die 32 and the second roller die 42 are synchronously withdrawn from the outer circumferential portion of the blank 7 in the direction of the arrow "X2".

After the hot rough-rolling step is terminated as described above, the cylinder 29 and the second motor 22 transfer the blank 7 further in the direction of the arrow "Y1" to dispose the blank 7 at the finish-forming location "R2" shown in FIG. 14. In this circumstance, on the basis of the squeezing synchronous command signals received from the controller system, the first finishing roller die 33, being rotated with the first roller die 32, is transferred in the direction of the arrow "X1" to be squeezed toward the blank 7. The second finishing roller die 43, being rotated with the second roller die 42, is transferred in the direction of the arrow "X1" to be squeezed to the blank 7 synchronously. Therefore, the teeth of the blank 7 are finish-rolled in the range of warm temperatures (from the starting temperature of approximately 600° C. through the terminating temperature of approximately 400° C.). After that, the first finishing roller die 33 and the second finishing roller die 43 are transferred in the direction of the arrow "X2" and are withdrawn from the blank 7.

In this embodiment, the squeezing synchronous precision between the first roller die 32 and the second roller die 42 is relatively high. As can be seen in FIG. 15, the distance between the central axis line of the blank 7 and the central axis line of the first roller die 32 is indicated as $L_L$, and the distance between the central axis line of the blank 7 and the central axis line of the second roller die 42 is indicated as $L_R$. Here, $L_L$ and $L_R$ correspond with each other. Thus, a teeth-groove runout in the rolled-gear can be decreased, advantageous in producing the rolled-gear having high accuracy.

Moreover, in this embodiment, as can be understood from FIG. 15, a first emitting device 76 for emitting liquid-lubricant is equipped to face the portion passed a rolling area in the first roller die 32. Also, a second emitting device 77 for emitting liquid-lubricant containing, for example, graphite powder is equipped to face the portion passed a rolling area in the second roller die 42. Namely, the first emitting device 76 and the second emitting device 77 are respectively separately disposed at the position being an angle of 90° apart. Accordingly, this apparatus is advantageous in uniform spray timing and spraying time of lubricant, and is advantageous in releasing a predetermined sprayed amount of lubricant with respect to the first roller die 32 and second roller die 42. So, this apparatus is advantageous in uniformalizing the lubricated property and the temperature distribution, and is advantageous in producing the rolled-gear having high-accuracy.

Figure 19:
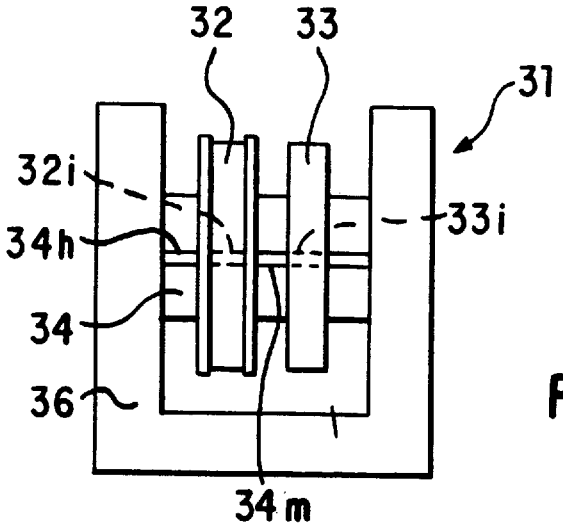
FIG. 19 is a side view which illustrates the roller squeezing apparatus.

FIG. 19 shows the first roller squeezing apparatus 31. As can be seen from FIG. 19, in the first roller squeezing apparatus 31, a keyway 34*h* is formed at the first connecting shaft 34, rotatablely held on the first housing 36, along the axial direction. Further, a mating keyway 32*i* is formed at the inner circumferential portion of the fitting hole of the first roller die 32, and the mating keyway 33*i* is formed at the inner circumferential portion of the fitting hole of the first finishing roller die 33. A key 34*m* is engaged with the mating keyways 32*i*, 33*i* and a keyway 34*h* formed at the first connecting shaft 34, thereby the dies 32, 33 are integrated with respect to the circumferential direction.

Figure 20:
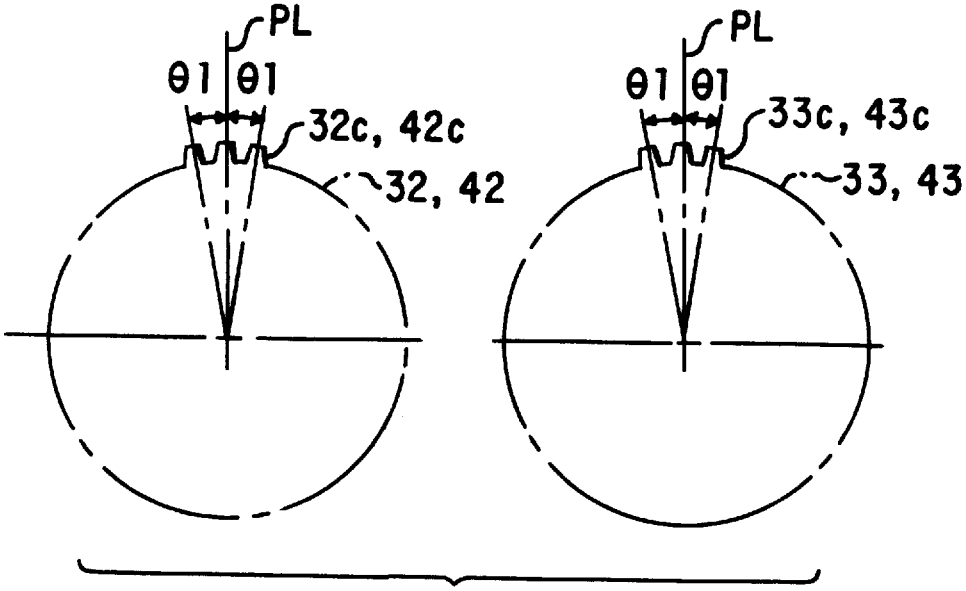
FIG. 20 is a constructive view depicting the forming teeth of the roller die and the forming teeth of the finishing roller die corresponding with each other in a circumferential direction.

Accordingly, as can be understood from FIG. 20, when the center of one of the forming teeth 32*c* in the roller die 32 is adjusted to the plumb-line "PL", the other of forming teeth 32*c* are disposed at intervals of θ1 angle degrees. Also, when the center of one of the forming-teeth 33*c* of the finishing roller die 33 is adjusted to the plumb-line "PL", the others of the forming teeth 33*c* are disposed at intervals of θ1 angle degrees. In other words, the circumferential phase of the forming teeth 32*c* of the roller die 32 agrees with the circumferential phase of the forming teeth 33*c* of the finishing roller die 33. Therefore, the aforementioned key and keyways operate as the forming teeth phase adjusting means. The total number of teeth in the finishing roller die 33 is as many as those of the roller dies 32. The total number of teeth in the finishing roller die 43 is as many as those of the roller die 43. Here, FIG. 20 shows only part of the forming teeth 32*c*, and 33*c*.

The second roller squeezing apparatus 41 has the similar construction to the first roller squeezing apparatus 31; therefore, as can be understood form FIG. 20, the aforementioned key and keyways adjust the circumferential phase of the forming die 42*c* of the second roller die 42 to the circumferential phase of the forming teeth 43*c* of the second finishing roller die 43.

Timing Chart

Figure 21:
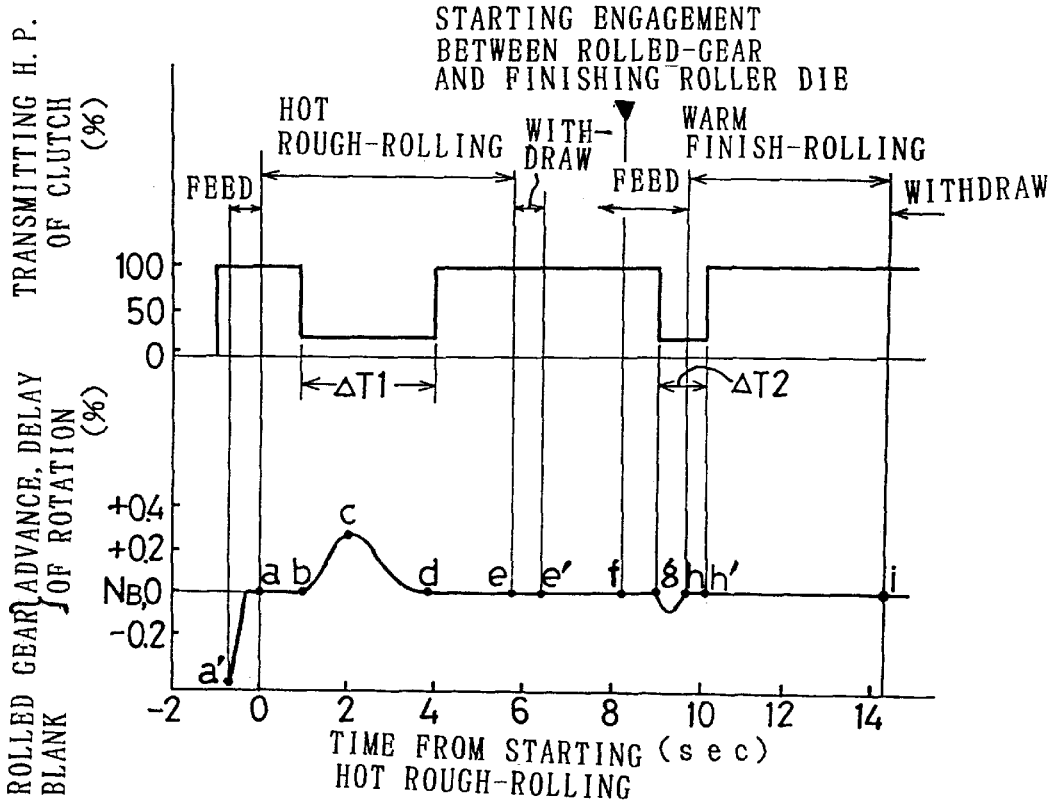
FIG. 21 is a timing chart depicting the gear-rolling process of the Preferred Embodiment.

FIG. 21 shows an example of timing charts where the rolling step is carried out by use of the embodiment apparatus. The horizontal axis in FIG. 21 shows the elapsed time when the starting time for the hot rough-rolling step is set at "0". The lower part of vertical axis in FIG. 21 shows advance and delay in the blank-rotation when a target rotational speed of the aforementioned blank 7 is set at $N_B$. The upper part of the vertical axis shows a ratio of horsepower (h.p.) in the torque transmitting variable clutch 26.

This ratio means the ratio at which the driving force of the third motor 23 is transmitted to the second blank holding portion 12.

From time-a' in FIG. 21, the roller dies 32, 42 begin to be fed in the squeezing direction. From time-a, being immediately after time-a', through time-e, the hot rough-rolling step is carried out with respect to the blank 7. From time-e, the roller dies 32, 42 are withdrawn from the rolled-gear 78 in the direction of the arrow "X2". From immediately after time-e', the finishing roller dies 33, 43 are begun to be fed in the squeezing direction (i.e., the direction of the arrow "X1"). At time-f, the forming teeth 33*c*, 43*c* of the finishing roller dies 33, 43 begin to engage with the teeth of rough rolled-gear 78.

In this embodiment, a target rotational speed $N_B$ is set as follows: The rotational speed of the roller dies 42(32) is indicated as $N_R$, the number of the teeth in the roller dies 42(32) is indicated as $Z_{RH}$, the number of the teeth in the rolled-gear 78 made from blank 7 is indicated as $Z_B$, where $$N_B = N_R \times [Z_{RH}/Z_B]$$

Here, the number of the teeth of finishing roller dies 33, 43 is set at that of the roughing roller dies 32, 42, namely, $Z_{RH}$.

As can be seen from FIG. 21, the blank 7 is basically rotated at the target rotational speed $N_B$ except during specified periods. Thus, the controller system, which operates as an engagement controlling means, controls the second holding shaft 12*a* of the second blank holding portion 12 in order to control the blank 7 without advance and delay with respect to the target rotational speed $N_B$. Also, the roller dies 32, 42, 33, 43 are controlled on the basis of the controller system to rotate at a rotational speed "$N_R$".

However, as shown from time-b to time-c in FIG. 21, the rotational speed of the blank 7 is gradually increased with the hot rough-rolling step progressing. For example, the rotational speed of the blank 7 is increased by approximately +0.3% with respect to the target rotational speed $N_B$. The engagement, which is between the teeth of the rolled-gear 78 and the forming teeth 32*c*, 42*c* of the roller dies 32, 42, is enhanced with the teeth of the rolled-gear 78 generated so that the rotational speed of the rolled-gear 78 is increased under the influence of the rotational driving force of the roller dies 32, 42.

Accordingly, as shown as ΔT1 in FIG. 21, the controller system controls the transmitting torque variable clutch 26 from time-b through time-d to decrease the rate of the transmitted horsepower in the range of less than approximately 50% and to decrease the transmitting of the driving force from the third motor 23. Thus, the rotational speed of the blank 7 (i.e., the rolled-gear 78) returns again to the target rotational speed $N_B$. Therefore, the rotational speed of the blank 7 returns to the target rotational speed NB at time-d where the teeth are fitted to be a nearly steady state with the sizing operation progressing.

In this example, since the hot rough-rolling step is terminated at time-e, roller dies 32, 42 are withdrawn from the rolled-gear 78 at time-e. Also, at time-e, the controller system controls the transmitting torque variable clutch 26 in such a manner that the transmitting horsepower efficiency is returned to approximately 100%; Hence, the rotational speed of the blank 7 (i.e., the rolled-gear 78) is kept at the target rotational speed $N_B$.

Also, the finishing roller dies 33, 43 begin to engage with the rolled-gear 78 at time-f, and the rotational speed of the blank 7 (i.e., the rough roller-gear 78) is kept at the target rotational speed $N_B$. As mentioned above, because of the key 34*m* and the keyways 32*i*, 33*i*, the forming teeth 32*c* of the first roughing roller die 32 and the forming teeth 33*c* of the first finishing roller die 33 agree with each other in the circumferential phase. Similarly, the teeth 42*c* of the second roughing roller die 42 and the forming teeth 42*c* of the second finishing roller die 43 agree with in the circumferential phase. Further, the roller die 32, 33, 42, 43 are controlled to be rotated usually at the constant rotational speed $N_R$ on the basis of the controller system.

In this embodiment including the aforementioned construction, when the warm finish-rolling step is started, the relationship which exists between the teeth 78*c* of the rough-rolled gear 78 and the forming teeth of the roller die 32 and which exists immediately after the termination of the hot rough-rolling step, is maintained. Therefore, the teeth 33*c*, 43*c* of the finishing roller dies 33, 43 can be smoothly engaged with the teeth 78*c* of the rolled-gear 78.

What is claim is:

1. A process for gear-rolling a high accuracy gear from a workpiece made of iron-based material using:

a roller die for generating teeth and a finishing roller die for finishing the teeth; and the process comprising the steps of:

a heating step of heating an outer circumferential portion of said workpiece having a disk shape;

a hot rough-rolling step of hot-rolling said outer circumferential portion of said heated workpiece by use of said roller die to generate teeth at said outer circumferential portion of said workpiece so that a rolled-gear is formed; and a warm finish-rolling step of warm-rolling said teeth of said rolled-gear by use of said finishing roller die, wherein said hot rough-rolling step has a starting temperature $T_1$ set in the range from approximately 850° through 1100° C., and a terminating temperature $T_2$ of said hot rough-rolling step set in the range from approximately 500° through 700° C., and wherein said warm finish-rolling step has a starting temperature $T_3$ set in the range from approximately 400° through 700° C., and a terminating temperature $T_4$ of said warm finish-rolling step set in the range from approximately 200° through 650° C.

2. The process for gear-rolling a high accuracy gear according to claim 1 using a roller squeezing apparatus in which said roller die and said finishing roller die are connected and disposed coaxially, and wherein said roller die contains a plurality of forming teeth arranged in a circumferential direction for said hot rough-rolling step, and said finishing roller die contains a plurality of forming teeth arranged in a circumferential direction for said warm finish-rolling step.

3. The process for gear-rolling a high accuracy gear according to claim 1 using a roller squeezing apparatus in which said roller die and said finishing roller die are connected and disposed coaxially, and wherein said warm finish-rolling step is continuously carried out immediately after said hot rough-rolling step without allowing a significant decrease in temperature of said rolled gear.

4. The process for gear-rolling a high accuracy gear according to claim 3 using said roller die for generating teeth and said finishing roller die for finishing the teeth with said roller die and said finishing roller die each comprising first and second roller squeezing apparatuses disposed on radially opposite sides of said workpiece;

the process further comprising the step of;

controlling a phase difference between the first and second roller squeezing apparatuses of said roller die and said finishing roller die by controlling relative rotating angles of said first and second roller squeezing apparatuses.

5. The process for gear-rolling a high accuracy gear according to claim 1, further comprising the steps of:

cooling said workpiece after said hot rough-rolling step;

a second heating step of heating said outer circumferential portion of said workpiece; and a second cooling step of cooling said workpiece prior to said warm finish-rolling step.

6. The process for gear-rolling a high accuracy gear according to claim 1, wherein said heating step is carried out by use of induction heating to heat said outer circumferential portion of said workpiece.

7. The process for gear-rolling a high accuracy gear according to claim 1, wherein said starting temperature $T_1$ is set to approximately 950° C., said terminating temperature $T_2$ is set to approximately 650° C., said starting temperature $T_3$ is set to approximately 600° C., and said terminating temperature $T_4$ is set to approximately 450° C.

8. The process for gear-rolling a high accuracy gear according to claim 1 using a workpiece holding portion for holding said workpiece and including a first workpiece holding portion and a second workpiece holding portion situated axially of said workpiece, the process further comprising the steps of;

holding said workpiece by use of at least one of said first workpiece holding portion and said second workpiece holding portion before said heating step, wherein said heating step is carried out with said workpiece being held by at least one of said first workpiece holding portion and said second workpiece holding portion.

9. The process for gear-rolling a high accuracy gear according to claim 8, wherein workpiece holding rigidity of said first and second workpiece holding portions is set more rigid than approximately 0.1 mm/tonf.

10. The process for gear-rolling a high accuracy gear according to claim 1 using a roller squeezing apparatus comprising a first roller squeezing apparatus and a second roller squeezing apparatus facing each other and disposed radially of said workpiece so as to form said outer circumferential portion of said workpiece to generate said teeth, and wherein the average difference between the distances from the center of said workpiece to outer edges of said first roller squeezing apparatus and said second roller squeezing apparatus is set in the range from approximately 0.005 mm through 0.03 mm.

11. The process for gear-rolling a high accuracy gear according to claim 1 using a roller squeezing apparatus comprising a first roller squeezing apparatus and a second roller squeezing apparatus facing each other and disposed radially of said workpiece so as to form said outer circumferential portion of said workpiece, said first roller squeezing apparatus comprising said roller die and said finishing roller die being disposed and connected coaxially, and said second roller squeezing apparatus comprising a second roller die and a second finishing roller die being disposed and connected coaxially in the axial direction of said second roller die.

12. The process for gear-rolling a high accuracy gear according to claim 1, wherein the decrease in temperature of said workpiece subjected to hot rough-rolling from $T_1$ to $T_2$ passes through a transformation point at which a structure-refining effect occurs.

* * * * *